US006778158B2

(12) United States Patent
Sun

(10) Patent No.: US 6,778,158 B2
(45) Date of Patent: Aug. 17, 2004

(54) PRE-CHARGING DISPLAY APPARATUS

(75) Inventor: Wein-Town Sun, Kaohsiung (TW)

(73) Assignee: Au Optronics Corporation, Hsinchu (TW)

( * ) Notice: Subject to any disclaimer, the term of this patent is extended or adjusted under 35 U.S.C. 154(b) by 249 days.

(21) Appl. No.: 10/064,425

(22) Filed: Jul. 12, 2002

(65) Prior Publication Data

US 2003/0214470 A1 Nov. 20, 2003

(30) Foreign Application Priority Data

May 15, 2002 (TW) ..... 91110098 A

(51) Int. Cl.[7] ..... G09G 3/36
(52) U.S. Cl. ..... 345/87; 345/100
(58) Field of Search ..... 345/87, 88, 90, 345/91, 92, 94, 98, 99, 100

(56) References Cited

U.S. PATENT DOCUMENTS 5,764,207 A * 6/1998 Maekawa et al. ..... 345/99
5,973,658 A * 10/1999 Kim et al. ..... 345/92
2002/0093474 A1 * 7/2002 Toyoshima et al. ..... 345/87
2002/0118154 A1 * 8/2002 Kim ..... 345/87
2004/0012555 A1 * 1/2004 Yamashita et al. ..... 345/100
2004/0047530 A1 * 3/2004 Hara et al. ..... 385/8

* cited by examiner

*Primary Examiner*—Vijay Shankar
*Assistant Examiner*—Nitin Patel
(74) *Attorney, Agent, or Firm*—Jiang Chyun IP Office

(57) ABSTRACT

The present invention provides a pre-charging display apparatus. By adding a set of the pre-charging switch resistors, a pre-charging control transistor, and a pre-charging control signal, and because the pre-charging control transistor is OFF when the set of the pre-charging switch transistors are set to ON by the pre-charging control signal, the common capacitor on the common line of the matrix panel (or the inverse electrode of the color filter panel) according to the present invention can transmit its stored charges to data lines to pre-charge the data lines. Therefore, the present invention can improve the charging condition inside the pixels. Moreover, by using the charges that are stored in the data lines and are inverse to the ones in the common capacitor to help the inversion of the voltage polarity of the common voltage, the present invention can save the power consumption needed to charge the data lines and the electrodes of the common voltage, so as to further significantly save the power consumption of the panel and also improve the rising time delay and the falling time delay of the common voltage.

10 Claims, 4 Drawing Sheets

PRE-CHARGING DISPLAY APPARATUS

CROSS REFERENCE TO RELATED APPLICATIONS

This application claims the priority benefit of Taiwan application serial no. 91110098, filed May 15, 2002.

BACKGROUND OF INVENTION

1. Field of Invention

The present invention generally relates to a display, and more particularly, to a pre-charging display apparatus.

2. Description of Related Art

The movie was the earliest dynamic image that human beings could see. Afterwards, with the invention of the cathode ray tube (CRT), the commercial television successfully derived from the CRT and became an essential electronic appliance for every family. Accompanying the development of these technologies, the CRT applications further extended to the desktop monitors in the computer industry, so that the CRT has prevailed for several decades. However, each type of display made by the CRT faces the same radiation problem, and due to the structural limitation of the internal electron gun, the size of the display is quite big, making it take up a big space. Therefore, it is not easy to make it thinner and lighter.

Due to the problems mentioned above, researchers have developed the so-called flat panel display, comprising the liquid crystal display (LCD), the field emission display (FED), the organic light emitting diode (OLED), and the plasma display panel (PDP). Wherein, the LCD is the most notable technique among them, it equips the characteristics of the thinner, lighter, small size, medium size and large size, it also complies with the techniques of modern and new era portable mobile wireless communication and networks.

To avoid liquid crystal decomposition and to assure operation life time, an AC drive is used to drive the LCD. The base drive method comprises the static drive method and the dynamic drive method. The static drive method is applied in the field of small scale fixed graph display such as the game apparatus and toy. The dynamic drive method is mainly applied in other fields.

The dynamic drive method comprises two major categories, one is the simple matrix drive method and the other one is the active matrix drive method. The simple matrix drive method is generally used in the twisted nematic (TN) LCD and the super twisted nematic (STN) LCD. The active matrix drive method is generally used in the thin film transistor (TFT) LCD. The matrix drive method uses one of the column electrode and the row electrode as a scanning signal electrode, and use the other one as a data signal electrode. The matrix drive method generally uses a one line at a time scanning method, and its characteristic is (n×m) pixels are controlled by (n+m) (where n and m are the positive integers) electrodes.

Many drive methods had been proposed for the active matrix LCD. One of the conventional drive methods is a method for pre-charging the data line proposed by Sony Japan Corporation in 1995 (U.S. Pat. No. 005,764,207). The method performs a pre-charging operation onto the data line first, and subsequently improves the charging speed onto the pixels. However, this method has to add the pre-charging signal and the pre-charging control signal, so that the power consumption of the LCD panel is increased.

Another conventional drive method issued by A. Erthart and others in 1997 applies the charge sharing theory used on the dynamic random access memory (DRAM) circuit to the design of the LCD drive circuit. In this method, when the dot inversion or the column inversion are adopted in the LCD panel, since the signal polarity on the contiguous data lines are inverse with each other, the charging and discharging operation have to be repeatedly applied onto the data lines to write the data with inverse polarity into the same row in the duration of one frame time. Therefore, the power of the parasitic capacitance originally stored in the data line is wasted. In order to re-utilize the power of this portion, A. Erthart and others proposed coupling all data lines having the inverse polarity together, or jointly coupling all data lines to an external capacitor, and with the charge sharing theory subsequently applied on it, the data line can be pre-charged in advance to almost half of the inverse polarity voltage level, so that the external drive circuit only has to charge the other half that is not charged yet. Therefore, when the polarity on the data line reverses, almost half of the power consumption of the drive circuit can be saved (when the power consumption of the back light panel is not considered).

In order to save the power consumption of the LCD panel, one of the drive methods used is called the Vcom swing drive method, in which the common voltage provided by the external voltage source swings within a certain amplitude rather than sustains at a constant value. This drive method adopts the drive method of the frame inversion or line inversion (also known as row inversion) to write data in. Generally speaking, in order to improve the image quality, the line inversion is preferably adopted, and the low temperature Poly-Si (LTPS) panel mainly adopts this type of the drive method. To have better understanding of it, please refer to FIG. 1, a sketch map of a conventional display apparatus 10. The display apparatus 10 comprises 4 scanning lines (SL1–SL4) 102, 5 data lines (DL1–DL5) 104, 16 pixels 106, a vertical drive circuit 108, a signal drive circuit 110, 5 switches 112, a horizontal drive circuit 114, a common capacitor Ccom 116, and a common resistor Rcom 118. As shown in FIG. 1, the data lines (DL1–DL4) 104 comprise a plurality of data line parasitic resistors 120 and a plurality of data line parasitic capacitors 122, and each of the pixels 106 comprises a transistor 124 and a storage capacitor plus liquid crystal capacitor 126. The function of each part of the display apparatus 10 is described in detail hereinafter.

The scanning lines (SL1–SL4) 102 are arranged in row. The data lines (DL1–DL5) 104 are arranged in columns and intercrossed with the scanning lines (SL1–SL4) 102. Each of the pixels 106 is arranged on the intersection of each of the scanning lines 102 and each of the data lines 104. The vertical drive circuit 108 jointly couples to the scanning lines (SL1–SL4) 102 to provide a plurality of continuous row selection pulses for each of the scan lines 102. The signal drive circuit 110 generates the video signals (Video). The switches 112 jointly couple to the signal drive circuit 110 and the data lines (DL1–DL5) 104. When the switches 112 are ON, the video signals (Video) are transmitted to the data lines (DL1–DL5) 104. The horizontal drive circuit 114 jointly couples to the switches 112 to generate a plurality of continuous sampling pulses to control the ON/OFF of the switches 112. The common capacitor Ccom 116 has two electrodes, one electrode is jointly coupled to the pixels 106, and the other electrode is jointly coupled to the ground. The common resistor Rcom 118 has two electrodes, one electrode is jointly coupled to the pixels 106 and the common capacitor Ccom 116, and the other electrode is jointly coupled to the common voltage Vcom. Moreover, the common voltage Vcom is provided by a voltage source.

FIG. 2 schematically shows a timing diagram of the video signal Video, the data line voltage DL, the real common voltage Vcom, and the common voltage Vcom of a conventional display apparatus 10. FIG. 2 is described herein accompanying FIG. 1. Since the resistor capacitance load (composed of the common resistor Rcom 118 and the common capacitor Ccom 116) on the common line of the matrix panel (or the inverse electrode of the color filter panel) is very big when seen from the input terminal of the common voltage Vcom, when the voltage polarity of the common voltage Vcom reverses, the rising time delay or the falling time delay on the real common voltage Vcom happen on a common line of the matrix panel (or the inverse electrode of the color filter panel). Moreover, there are also some concerns about insufficient charging when the charge characteristic of the data lines (DL1–DL4) 104 is high resolution.

SUMMARY OF INVENTION

Therefore, the present invention provides a pre-charging display apparatus. By adding a set of the pre-charging switch transistors, a pre-charging control transistor, and a pre-charging control signal, and because the pre-charging control transistor is OFF when the set of the pre-charging switch transistors are set to ON by the pre-charging control signal, the common capacitor of the present invention can transmit its stored charges to data lines to pre-charge the data lines. Therefore, the power consumption of panel can be saved and the charging condition inside the pixels can be improved.

In order to achieve the objectives mentioned above and others, the present invention provides a pre-charging display apparatus. The display apparatus comprises a plurality of scanning lines, a plurality of data lines, a plurality of pixels, a vertical drive circuit, a signal drive circuit, a plurality of switches, a horizontal drive circuit, a common capacitor, a common resistor, a plurality of pre-charging switch transistors, and a pre-charging control resistor. The plurality of scanning lines is arranged in row. The plurality of data lines is arranged in columns intercrossed with the scanning lines. Each of the pixels is arranged on the intersection of each scanning line and each data line. The vertical drive circuit jointly couples to the scanning lines to provide a plurality of continuous row selection pulses for each scan line. The signal drive circuit generates the video signals (Video). The switches jointly couple to the signal drive circuit and the data lines. When the switches are ON, the video signals (Video) are transmitted to the data lines. The horizontal drive circuit jointly couples to the switches to generate a plurality of continuous sampling pulses to control the ON/OFF of the switches. The common capacitor comprises a first electrode and a second electrode, the first electrode is jointly coupled to the pixels, and the second electrode is jointly coupled to the ground. The common resistor Rcom comprises a third electrode and a fourth electrode, the third electrode is jointly coupled to the pixels and the common capacitor. The plurality of pre-charging switch transistors jointly couple to the data lines, the common resistor, and the pre-charging control signal. Whether the pre-charging switch transistors are ON or OFF is controlled by the pre-charging control signal. The pre-charging control transistor jointly couples to the common resistor, the pre-charging switch transistors, the pre-charging control signal, and the common voltage. Whether the pre-charging control transistor is ON or OFF is controlled by the pre-charging control signal. Moreover, the type (n-type or p-type) of the pre-charging switch transistors and the type of the pre-charging control transistor must be different.

In an embodiment of the present invention, when the pre-charging switch transistors are set to ON by the pre-charging control signal, the pre-charging control transistor is OFF, so the common capacitor can transmit its stored charges to the data lines.

In an embodiment of the present invention, the pre-charging switch transistors can be the n-type thin film transistors or the p-type thin film transistors.

In an embodiment of the present invention, the pre-charging control transistor can be the n-type thin film transistor or the p-type thin film transistor.

In an embodiment of the present invention, the pre-charging control signal is generated by a control device.

In an embodiment of the present invention, the common voltage is generated by the voltage source.

In an embodiment of the present invention, the display apparatus adopts the common voltage swinging drive method.

In an embodiment of the present invention, the display apparatus is an active matrix liquid crystal display.

In summary, by adding a set of the pre-charging switch resistors, a pre-charging control transistor, and a pre-charging control signal, and because the pre-charging control transistor is OFF when the set of the pre-charging switch transistors are set to ON by the pre-charging control signal, the common capacitor of the present invention can transmit its stored charges to data lines to pre-charge the data lines. Therefore, the present invention can improve the charging condition inside the pixels. Moreover, by using the charges that are stored in the data lines and are inverse to the ones in the common capacitor to help the inversion of the voltage polarity of the common voltage, the present invention can save the power consumption needed to charge the data lines and the electrodes of the common voltage, so as to further significantly save the power consumption of the panel and also improve the rising time delay and the falling time delay of the common voltage.

BRIEF DESCRIPTION OF DRAWINGS

The accompanying drawings are included to provide a further understanding of the invention, and are incorporated in and constitute a part of this specification. The drawings illustrate embodiments of the invention, and together with the description, serve to explain the principles of the invention. In the drawings, FIG. 1 schematically shows a sketch map of a conventional display apparatus.

DETAILED DESCRIPTION

In the panel designed to adopt the common voltage swinging drive method, since the polarity of the common voltage is always inverse to the polarity of the data lines voltage, the present invention fully utilizes this characteristic, and a set of the pre-charging switch transistors, a pre-charging control transistor, and a pre-charging control signal are added, so as to the charges of the common capacitor (also known as the parasitic capacitor) stored on the common line of the matrix panel (or the inverse electrode of the color filter panel), by applying the charge sharing theory, when the set of the pre-charging switch transistors are set ON by the pre-charging control signal, the pre-charging control transistor is OFF, so the common capacitor can transmit the stored charges to the data lines before the polarity needs to be reversed to pre-charge the data lines.

Figure 1:
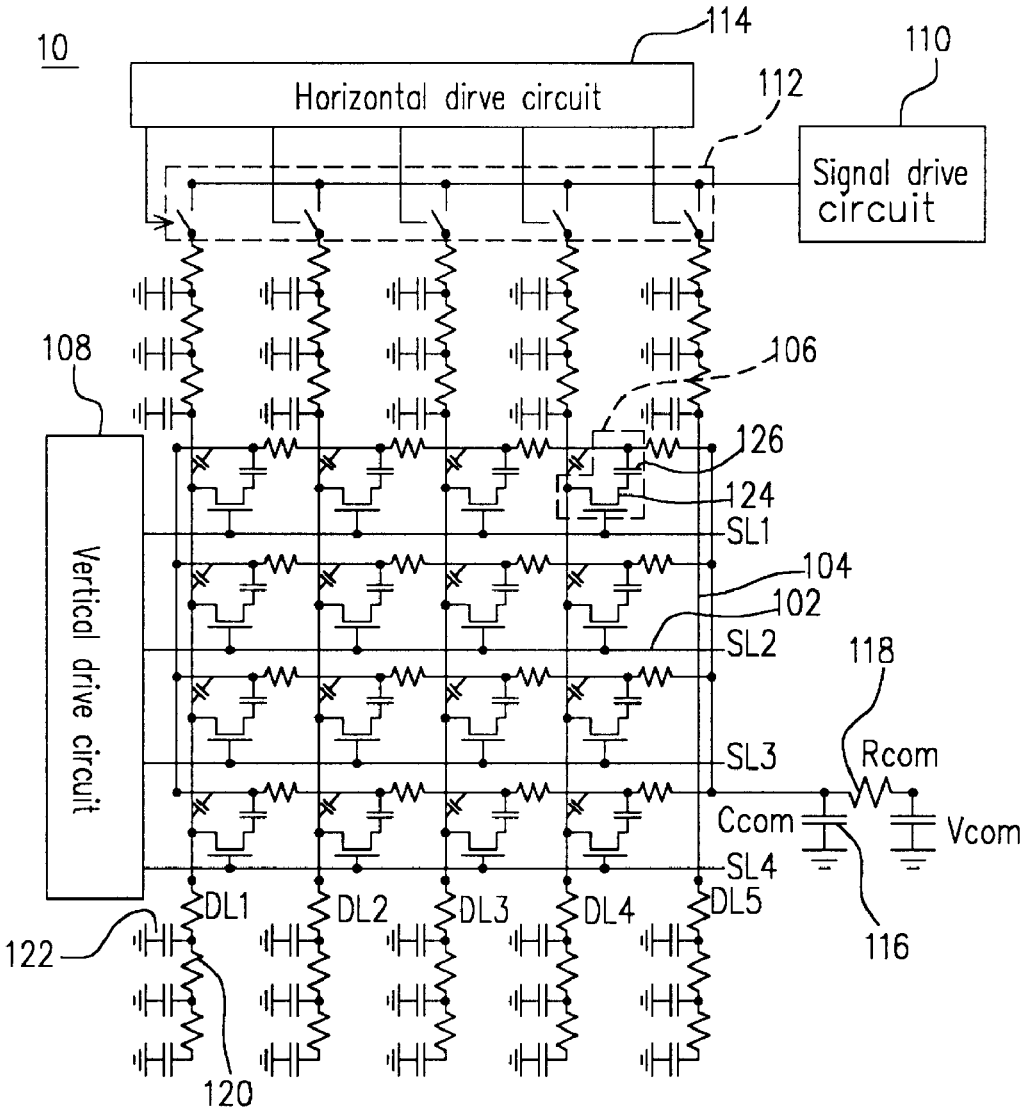
FIG. 1 (PRIOR ART)
Figure 2:
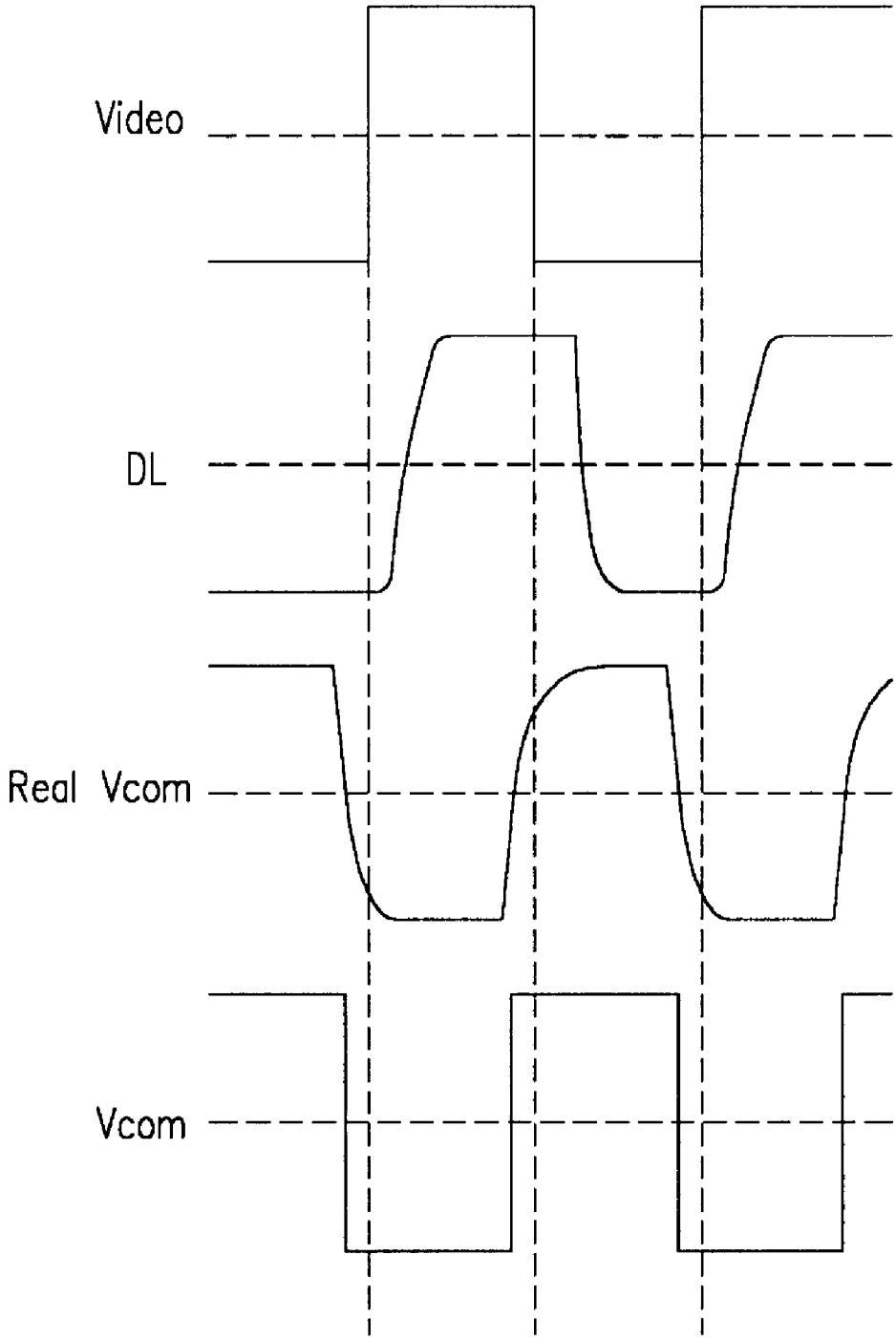
FIG. 2 (PRIOR ART)
FIG. 2 schematically shows a timing diagram of the video signal Video, the data line voltage DL, the real common voltage Vcom, and the common voltage Vcom of a conventional display apparatus.
Figure 3:
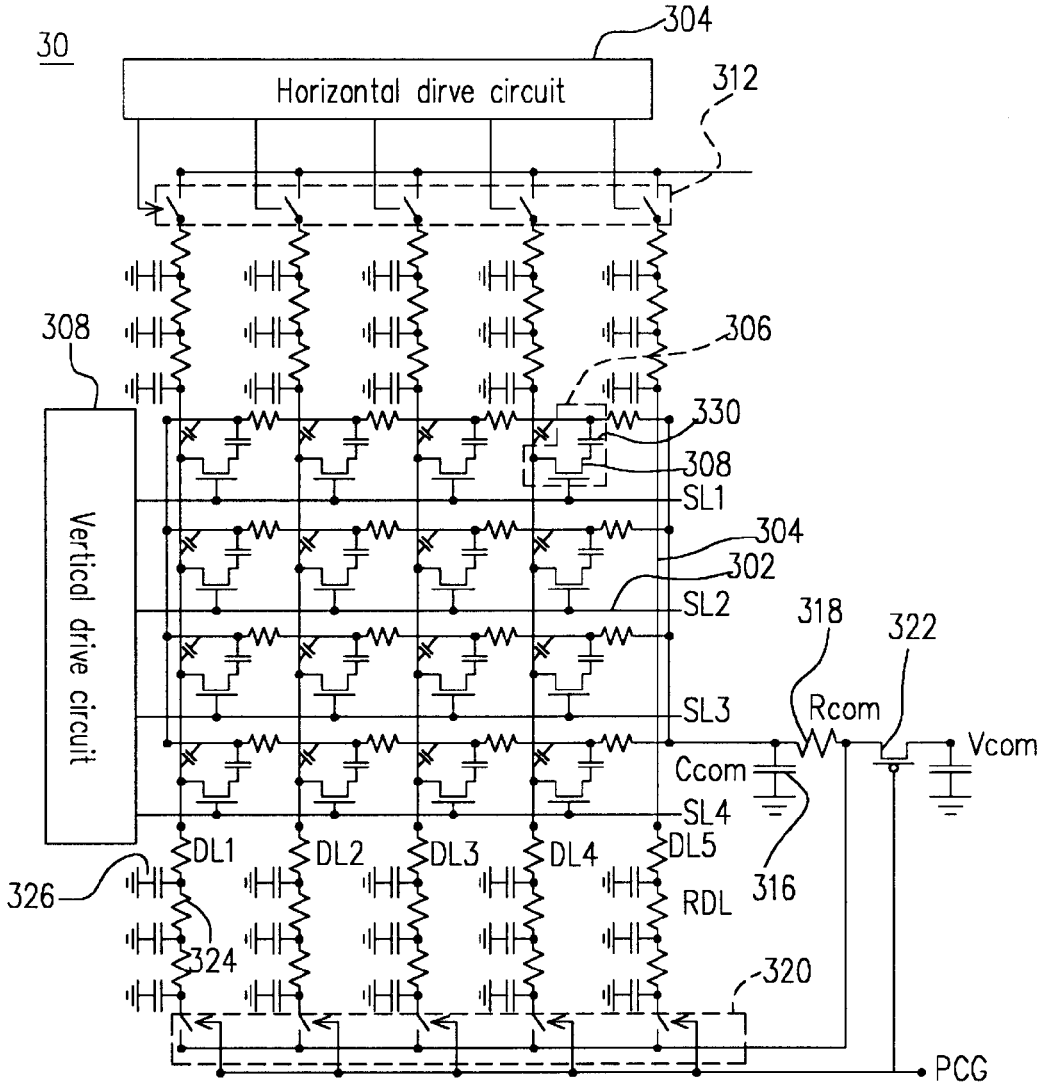
FIG. 3 schematically shows a sketch map of the pre-charging display apparatus of a preferred embodiment according to the present invention.

FIG. 3 schematically shows a sketch map of the pre-charging display apparatus of a preferred embodiment according to the present invention. In the preferred embodiment, for simplification, the display apparatus 30 only comprises 4 scanning lines and 5 data lines. However, for those who are skilled in the related art, it is apparent that the display apparatus 30 may comprises n scanning lines (where n is a positive integer) and m data lines (where m is a positive integer). The display apparatus 30 comprises 4 scanning lines (SL1–SL4) 302, 5 data lines (DL1–DL5) 304, 16 pixels 306, a vertical drive circuit 308, a signal drive circuit 310, 5 switches 312, a horizontal drive circuit 314, a common capacitor Ccom 316, a common resistor Rcom 318, 5 pre-charging switch transistors 320, and a pre-charging control transistor 322. As shown in FIG. 3, the data lines (DL1–DL5) 304 comprise a plurality of data resistors 324 and a plurality of data capacitors 326. Each of pixels 306 comprises a transistor 328 and a storage capacitor 330. Wherein, the pre-charging switch transistors 320 can be the n-type thin film transistors or the p-type thin film transistors. The pre-charging control transistor 322 may comprise one or more than one transistors, and it can be the n-type thin film transistor or the p-type thin film transistor. Moreover, the type (n-type or p-type) of the pre-charging switch transistors 320 and the type of the pre-charging control transistor 322 must be different. That is, if the pre-charging switch transistors 320 belong to n-type, the pre-charging control transistor 322 must belong to p-type. The function of each part of the display apparatus 30 is described hereinafter.

The scanning lines (SL1–SL4) 302 are arranged in row. The data lines (DL1–DL5) 304 are arranged in columns and intercrossed with the scanning lines (SL1–SL4) 302. Each of the pixels 306 is arranged on the intersection of each of the scanning lines 302 and each of the data lines 304. The vertical drive circuit 308 jointly couples to the scanning lines (SL1–SL4) 302 to provide a plurality of continuous row selection pulses for each of the scan lines 302. The signal drive circuit 310 generates the video signals (Video). The switches 312 jointly couple to the signal drive circuit 310 and the data lines (DL1–DL5) 304. When the switches 312 are ON, the video signals (Video) are transmitted to the data lines (DL1–DL5) 304. The horizontal drive circuit 314 jointly couples to the switches 312 to generate a plurality of continuous sampling pulses to control the ON/OFF of the switches 312. The common capacitor 316 has two electrodes, one electrode is jointly coupled to the pixels 306, and the other electrode is jointly coupled to the ground. The common resistor Rcom 318 has two electrodes, one electrode is jointly coupled to the pixels 306 and the common capacitor Ccom 316, and the other electrode is jointly coupled to the common voltage Vcom. Moreover, the common voltage Vcom is provided by a voltage source. The pre-charging switch transistors 320 jointly couple to the data lines 304, the common resistor Rcom 318, the pre-charging control transistor 322, and the pre-charging control signal PCG. Whether the pre-charging switch transistors 320 are ON or OFF are controlled by the pre-charging control signal. Wherein, the pre-charging control signal PCG is generated by a control device. The pre-charging control transistor 322 jointly couples to the common resistor Rcom 318, the pre-charging switch transistors 320, the pre-charging control signal PCG, and the common voltage Vcom. Whether the pre-charging control transistor 322 is ON or OFF is controlled by the pre-charging control signal. The operation theory of the pre-charging display apparatus 30 according to the present invention is as follows. When the pre-charging control signal PCG is at high voltage level, the pre-charging switch transistors 320 are ON and the pre-charging control transistor 322 is OFF. At this moment, the common capacitor Ccom 316 on the common line of the matrix panel (or the inverse electrode of the color filter panel) transmits its stored charges to the data lines 304 to pre-charge the data lines 304 via the common resistor Rcom 318 and the pre-charging switch transistors 320 before the polarity is reversed. Therefore, the present invention not only saves the power consumption of the panel, but also increases the speed of the charging to the data lines 304.

Figure 4:
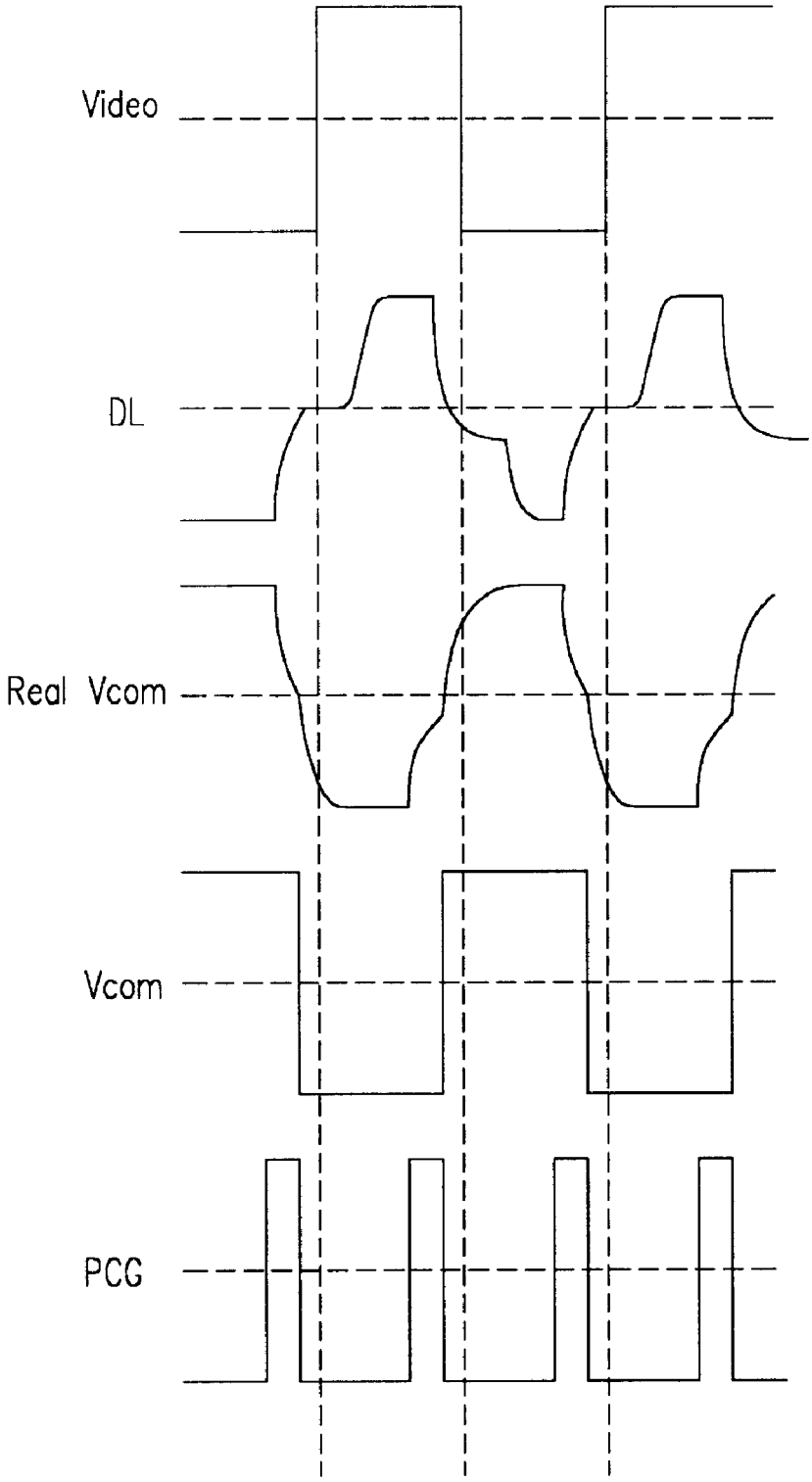
FIG. 4 schematically shows a timing diagram of the video signal Video, the data line voltage DL, the real common voltage Vcom, the common voltage Vcom, and the pre-charging control signal PCG of the pre-charging display apparatus of a preferred embodiment according to the present invention.

FIG. 4 schematically shows a timing diagram of the video signal Video, the data line voltage DL, the real common voltage Vcom, the common voltage Vcom, and the pre-charging control signal PCG of the pre-charging display apparatus 30 of a preferred embodiment according to the present invention. FIG. 4 is described accompanied with FIG. 3. When the pre-charging control signal PCG is at high voltage level, the pre-charging switch transistors 320 are ON and the pre-charging control transistor 322 is OFF. At this moment, the common capacitor Ccom 316 on the common line of the matrix panel (or the inverse electrode of the color filter panel) transmits its stored charges to the data lines 304 to pre-charge the data lines 304 via the common resistor Rcom 318 and the pre-charging switch transistors 320 before the polarity is reversed. Therefore, the present invention not only saves the power consumption of the panel, but also increases the speed of the charging to the data lines 304.

In summary, by adding a set of the pre-charging switch resistors, a pre-charging control transistor, and a pre-charging control signal, and because the pre-charging control transistor is OFF when the set of the pre-charging switch transistors are set to ON by the pre-charging control signal, the common capacitor of the present invention can transmit its stored charges to data lines to pre-charge the data lines. Therefore, the present invention can improve the charging condition inside the pixels. Moreover, by using the charges that are stored in the data lines and are inverse to the ones in the common capacitor to help the inversion of the voltage polarity of the common voltage, the present invention can save the power consumption needed to charge the data lines and the electrodes of the common voltage, so as to further significantly save the power consumption of the panel and also improve the rising time delay and the falling time delay of the common voltage.

Although the invention has been described with reference to a particular embodiment thereof, it will be apparent to one of ordinary skill in the art that modifications to the described embodiment may be made without departing from the spirit of the invention. Accordingly, the scope of the invention will be defined by the attached claims not by the above detailed description.

What is claimed is:

1. A pre-charging display apparatus, comprising:

a plurality of scanning lines, arranged in row;

a plurality of data lines, arranged in columns and intercrossed with the plurality of scanning lines;

a plurality of pixels, each of the plurality of pixels is arranged on an intersection of each of the plurality of scanning lines and each of the plurality of data lines;

a vertical drive circuit, jointly coupled to the plurality of scanning lines, used to provide a plurality of continuous row selection pulses for each of the plurality of scanning lines;

a signal drive circuit, used to generate a video signal;

a plurality of switches, jointly coupled to the signal drive circuit and the plurality of data lines, when the plurality of switches are ON, the image signal is transmitted to the plurality of data lines;

a horizontal drive circuit, jointly coupled to the plurality of switches, used to generate a plurality of continuous sampling pulses to control the ON/OFF of the plurality of switches;

a common capacitor, having a first electrode and a second electrode, wherein the first electrode is coupled to the plurality of pixels, and the second electrode is coupled to a ground;

a common resistor, having a third electrode and a fourth electrode, wherein the third electrode is coupled to the plurality of pixels and the common capacitor;

a plurality of pre-charging switch transistors, jointly coupled to the plurality of data lines, the common resistor, and a set of the pre-charging control signals, whether the plurality of pre-charging switch transistors are ON or OFF is controlled by the pre-charging control signal; and a set of pre-charging control transistors, jointly coupled to the common resistor, the plurality of pre-charging switch transistors, the pre-charging control signal, and a common voltage, whether the pre-charging control transistor is ON or OFF is controlled by the pre-charging control signal;

wherein, the type (n-type or p-type) of the plurality of the pre-charging switch transistors must be different from the type of the pre-charging control transistor.

2. The pre-charging display apparatus of claim 1, wherein when the plurality of pre-charging switch transistors are set to ON by the pre-charging control signal, the pre-charging control transistor is OFF, so the common capacitor transmits a plurality of stored charges to the plurality of data lines.

3. The pre-charging display apparatus of claim 1, wherein the plurality of pre-charging switch transistors are the n-type thin film transistors.

4. The pre-charging display apparatus of claim 1, wherein the plurality of pre-charging switch transistors are the p-type thin film transistors.

5. The pre-charging display apparatus of claim 3, wherein the pre-charging control transistor is the p-type thin film transistor.

6. The pre-charging display apparatus of claim 4, wherein the pre-charging control transistor is the n-type thin film transistor.

7. The pre-charging display apparatus of claim 1, wherein the pre-charging control signal is controlled by a control device.

8. The pre-charging display apparatus of claim 1, wherein the common voltage is generated by a voltage source.

9. The pre-charging display apparatus of claim 1, wherein the display apparatus adopts a common voltage swinging drive method.

10. The pre-charging display apparatus of claim 1, wherein the display apparatus is an active matrix liquid crystal display.

* * * * *